US006022303A

United States Patent [19]

Abdo

[11] Patent Number: 6,022,303

[45] Date of Patent: Feb. 8, 2000

[54] ABDOMINAL EXERCISE DEVICE

[75] Inventor: John S. Abdo, Algonquin, Ill.

[73] Assignee: AB-DO'ER LLC, Woodstock, Ill.

[21] Appl. No.: 09/006,147

[22] Filed: Jan. 13, 1998

Related U.S. Application Data

[60] Provisional application No. 60/040,134, Mar. 10, 1997.

[51] Int. Cl.[7] ..... A63B 23/02

[52] U.S. Cl. ..... 482/140; 482/121

[58] Field of Search ..... 402/92, 93, 95, 402/96, 121–123, 129, 130, 133, 134, 139, 140, 142, 908; D21/662, 673, 676, 686–691

[56] References Cited

U.S. PATENT DOCUMENTS

| | | | |
|---|---|---|---|
| 3,802,701 | 4/1974 | Good, Jr. | 482/119 |
| 3,947,025 | 3/1976 | Hobby, Jr. | 482/123 |
| 4,170,351 | 10/1979 | Ozbey et al. | 482/130 |
| 4,494,662 | 1/1985 | Clymer . | |
| 4,517,966 | 5/1985 | Von Othegraven | 482/140 |
| 4,603,858 | 8/1986 | Reehil . | |
| 4,687,197 | 8/1987 | Larsson et al. | 482/73 |
| 4,720,100 | 1/1988 | Du Buy | 482/136 |
| 5,052,684 | 10/1991 | Kousge et al. . | |
| 5,154,685 | 10/1992 | Chen | 482/126 |
| 5,232,425 | 8/1993 | Miller . | |
| 5,269,737 | 12/1993 | Sobotka . | |
| 5,334,122 | 8/1994 | Cole et al. | 482/130 |
| 5,522,783 | 6/1996 | Gordon | 482/127 |
| 5,730,688 | 3/1998 | Prusick | 482/130 |
| 5,759,138 | 6/1998 | Boland | 482/122 |

*Primary Examiner*—Richard J. Apley
*Assistant Examiner*—Lori Baker
*Attorney, Agent, or Firm*—Law Office of Leon I. Edelson; Leon I. Edelson

[57] ABSTRACT

An abdominal exercise device is disclosed which comprises a base support member assembly upon which the user sits, a vertical resistance and restorative force member assembly mounted on the base support member assembly, and an arm support member. The arm support member positions the body of the user in an upright position. The invented exercise device permits the user to train and strengthen the major and minor muscles of the upper and lower back, to train the frontal portion of the midsection, the abdominals, the obliques to avoid spinal compression and to maintain decompression of the spinal vertebrae.

8 Claims, 3 Drawing Sheets

ABDOMINAL EXERCISE DEVICE

This application claims the benefits of Provisional Patent application Ser. No. 60/040,134, filed Mar. 10, 1997.

BACKGROUND OF THE INVENTION

1. Field of Invention

The field of this invention relates to an exercise device for exercising all of the major muscles of the upper and lower abdomen, the internal and external obliques and rectus abdominus, the muscles of the spinal column including the erector spinal, and the intercostals, steratus anterior, latissmus dorsi, trapezius, fascia infraspinata, teres minor and teres major, without putting undue strain on the lumbar and the cervical spinal discs and the muscles comprising the lower back and hip flexors. The exercise device provides training of the frontal portion of the midsection, the abdominals, and isolating benefits to the obliques and the muscles of the spinal column.

Swaying, pivoting, rocking, bending forward, backward, sideways, and conditioning, circular, twisting, lateral bending, forward flexion, rearward extensions, and rotating motions of the upper body are basic movements of the human body. Movement of such nature against resistance has an effect upon the expansion and contraction of the affected muscles of the abdomen, of the spinal column and of the lower back to strengthen and tone all of the major muscles of the upper and lower abdomen, the obliques and major muscles of the spinal column.

As can be appreciated, any motion of the human body wherein undue stress is placed upon the muscles of the lower back negates any benefit of muscular activity and therefore is an unbalanced approach to training and strengthening the muscles of the abdomen and of the mid-to-lower spinal regions. The integrity and strength of the lower back muscles and of the frontal abdominals and of the external obliques are imperative to leading a physically active life style. The training and strengthening of the muscles of the lower back and not just the muscles of the frontal abdomen and the external obliques without offering undue strain and stress upon the muscles of the lower back, including the fascia infraspinata, or on the five lumbar or on the spinal discs, requires balancing the intensity and stress of the training movements of the human body. The invented abdominal exercise device permits the user to train and strengthen all of the muscles of the entire section of the body without undue strain on the muscles of the lower back or of the lumbar region. The muscles of the lower back are trained to support the spinal column, thus avoiding spinal compression, and to maintain the decompression of the spinal vertebrae.

2. Description of the Prior Art

Conventional approaches to the problem of training and strengthening the muscles of the human body utilize a means of providing resistance to body movements of the user. A problem can result in that resistance offered to movement of the human body and of specific muscles can lack any controlling means to prevent any unbalanced stress or strain that may induce injury by an uncontrolled movement. For example, Clymer, U.S. Pat. No. 4,494,662, teaches an exercise device which includes a spring mounted handle carried on a base which in turn can be carried on a support platform. The user can stand on the platform, which is mounted for back and forth rotary movement and is spring-based to resist movement of the feet of user. Any movement of the spring mounted handles is opposed by the spring. Resistive forces are thereby transmitted back through the arms and body of the user to his legs and feet. Similarly, Reehil, U.S. Pat. No. 4,603,858, teaches an exercise device wherein the user grasps two handles and presses against a spring-loaded structural member which is belted to the user's mid-section and restrained from movement by two body contact pads, one at the chest, the other at the thighs of the user. Kosuge, U.S. Pat. No. 5,052,684 teaches an apparatus for training the waist portion of the human body wherein the user sits upon a rotatable table with his arms supported by a horizontal U-shaped arm support which pivots counter-clockwise to the clockwise movement of the rotatable table upon which the user sits. A restraining force against rotation of the table and the pivoting of the arm support is provided by a friction brake, the rotational force being supplied by the user. But the user, by his twisting movement in a horizontal movement exercises his waist muscles in a limited range of motion. Miller, U.S. Pat. No. 5,232,425, teaches an exercise device for exercising the abdominal muscles wherein the user holds a rigid shaft between his legs, the shaft affixed to a horizontal handle for the hands of the user. Movement of the shaft within a shaft housing is restrained by elastic bands. The user exercises by pressing downward upon the shaft which is held between his legs and performing repetitions of "sit up" motions, thus exercising his abdominal muscles. Sobotka, U.S. Pat. No. 5,269,737, teaches an exercise device comprising a shoulder bar held upon the shoulders of the user, back of the neck, by the hands of the user. Elastic straps attached to the shoulder bar are anchored to a combined seat and seat bar which is held steady by the user's body weight. Resistance to body movement is provided by the elastic straps so as to exercise the oblique and waist muscles of the user as well as the muscles of the upper torso and mid-section of the user.

A disadvantage of the exercise device taught by Clymer '662, Reehil '858, Miller '425 and Sobotka '737 is that the user is not supported in the upper body and is not restrained in body movement so as to prevent undue stress being paced upon the muscles of the lower back and of the lumbar region. The user's body accordingly can be subjected to an unbalanced approach to training and strengthening the muscles of the abdomen and of the mid-to-lower spinal regions. Exercise devices taught by Clymer '662, Reehil; 858, Miller '425, and Sobotka '737 are functional for their intended purposes and illustrate the difficulty of achieving a balanced approach to exercising and strengthening the muscles of the abdomen and mid-section of the body of the user and yet prevent undue stress or strain upon the muscles of the lower back and lumbar region.

The exercise device taught by Kosuge '684 restricts the body movements of the user to pivoting motions of the upper body to the lower body in waist twisting movements. The waist twisting movements are restrained by a friction brake to provide resistance to the waist twisting movement. As the upper body is supported by arm supports which encircle the user's body, the user's body movement is limited to a twisting movement consisting of turning the upper body in opposition to the lower body in an oscillatory sequence. Strengthening and training of the body muscles accordingly is limited to muscles of the waist portion of the human body without a balanced approach to exercising and strengthening the muscles of the abdomen and mid-section of the body of the user.

Accordingly, as can be observed from the description of the above exercise devices, a balanced approach to the problem of exercising the mid-section of the body by use of an exercise device without causing undue stress or strain upon the muscles and vertebrae of the lower back or the thoracic and lumbar region has been hampered by availability of exercise devices which permit and promote a full range of body movements to strengthen and exercise the mid-section of the body.

The object of the present invention is a solution to the above problem, being a simple exercise device which permits the exercise and strengthening of the mid-section of the body but which protects and serves to reduce undue stress and strain upon the lower back and the lumbar region. It is a further object of this invention to provide a balanced approach to the problem of exercising the mid-section of the body wherein the user is positioned so as to naturally assume the necessary exercise position of being seated with arm support and the back muscles being properly supported during the exercise movements, yet, training and strengthening benefits are provided to the obliques and muscles of the spinal column.

SUMMARY OF THE INVENTION

The abdominal exercise device of this invention comprises a base support member assembly upon which the user sits, a vertical resistance and restorative base member assembly mounted upon the base support member assembly and a horizontal U-shaped arm support member. The horizontal U-shaped arm support member comprises a bar which extends around the upper body of the user to position and to support the arms of the user and the upper body. The horizontal U-shaped arm support member is mounted on the vertical resistance and restorative force member assembly. The vertical resistance and restorative force member assembly provides resistance and restorative force to any movement by the user of the abdominal exercise device, whether forward, backward, twisting, circular or sideways. The vertical resistance and restorative force member assembly provides controlled resistance and restorative force to movements of the horizontal U-shaped arm support member which is grasped by the hands of the user. The range of movement of the horizontal U-shaped arm support member is limited only by the user's ability to bend forward, backward, sideways, and to twist against the restraining force of the vertical resistance and restorative force member assembly, thus allowing a full range of movement by the user. The vertical resistance and restorative force member assembly includes an energy storage device such as a spring or an elastomeric embodiment of a natural or synthetic polymer which resist repetitive deformation stress. The arm support member positions and supports the arms and upper body of the user to support the muscles of the spinal column, to train the oblique muscles of the body and to avoid spinal compression by maintaining decompression of the spinal vertebrae.

DETAILED DESCRIPTION OF THE INVENTION

Figure 1:
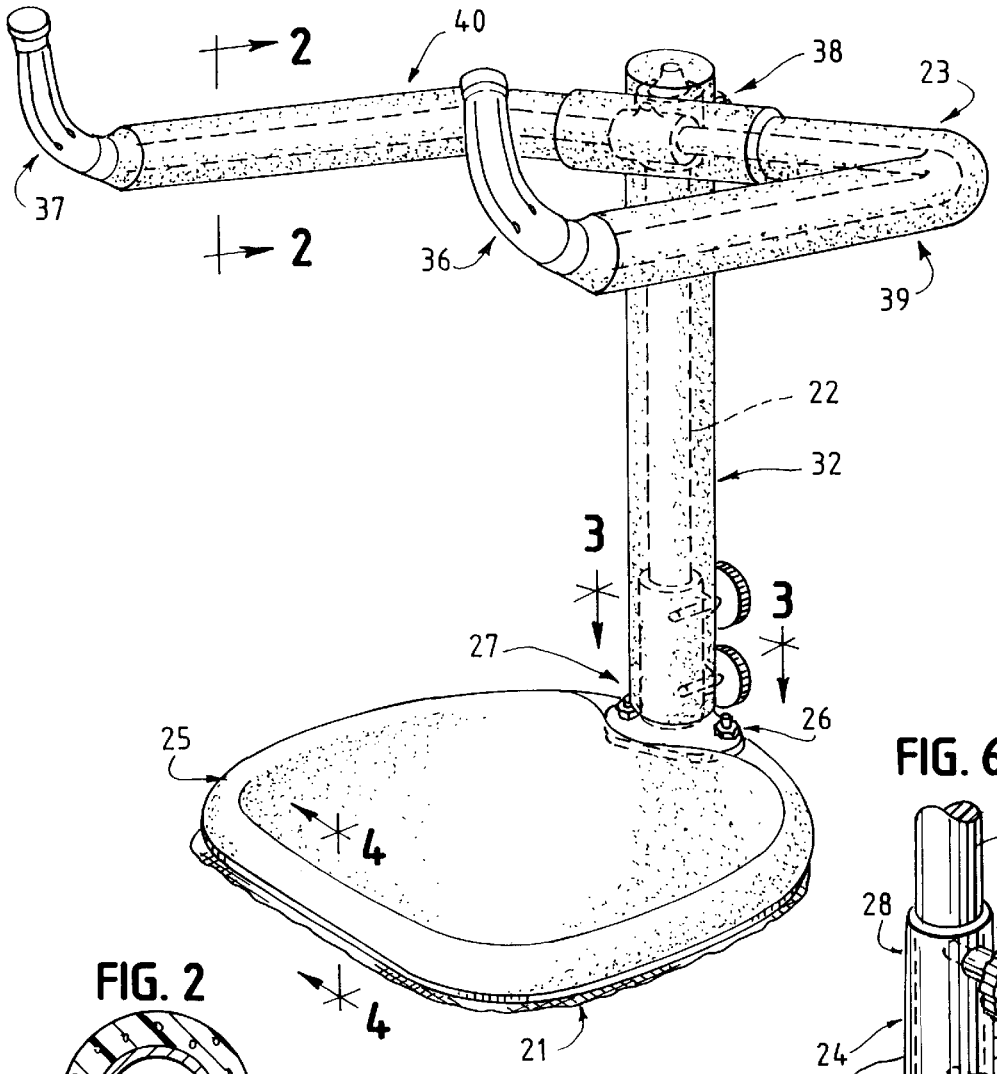
FIG. 1 is a perspective view of the abdominal exercise device of the present invention.

While the present invention is open to various modifications and alternative constructions, the embodiments shown in the drawings will be described here in detail. It is understood, however, there is no intention to limit the invention to the particular form described. On the contrary, it is intended that the invention cover all modifications, equivalences and alternative constructions falling within the spirit and scope of the appended claims.

The abdominal exercise device of this invention comprises a base support member assembly upon which the user sits, a vertical resistance and restorative force member assembly mounted upon the base support member assembly and a horizontal U-shaped arm support member. The horizontal U-shaped arm support member positions and supports the arms and upper body of the user to support the muscles of the spinal column of the user and to train the oblique muscles of the body in a balanced procedure which resists applications of strain to the lower back muscles and avoids spinal compression by maintaining decompression of the spinal vertebrae. The vertical resistance and restorative force member assembly provides controlled resistance and restorative force to movements of the U-shaped arm support member by utilizing an energy storage device such as a spring or an elastomeric embodiment of a natural or synthetic polymer such as rubber which resists repetitive deformation stress. Other energy storage devices such as torsion bars and hydraulic devices are suitable. The energy storage device of the vertical resistance and restorative force member assembly can also comprise a vertical column with a ball and socket joint at the pivot point of the vertical column wherein the vertical column is positioned within an elastomeric material resistant to deformation stress, thus providing restorative force to the vertical column to an upright position.

A full range of movement is accordingly provided for the user of the abdominal exercise device and permits training of the frontal portion of the user's mid-section, the abdominals with isolating benefits to the oblique muscles and the muscles of the spinal column.

With reference now to the drawings, a new and improved abdominal exercise device embodying the principles and concepts of the present invention will be described.

The abdominal exercise device of the present invention has been designed according to the principles and concepts of training the upper and lower abdominal muscles, of training the lower back muscles to support the spinal column and of training the oblique muscles in a balanced procedure which resists application of strain to the lower back muscles. Movements of the torso of the user can be by bending and twisting the torso, forward and backward leans, circular pivots, side-to-side bends and all other related movements and combinations of movements.

Design of an abdominal exercise device requires that tension be present throughout any body movement. The vertical resistance support member assembly of this invention offers resistance so that all movements of the body encounters resistance to the muscular activity. The arm support member resists movements of the upper torso but controls application of stress to lumbar and spinal column muscles.

The abdominal exercise device of this invention consists of a base support member assembly upon which the user sits and which connects to the vertical resistance and restorative force member assembly which in turn is used to connect to the arm support member. The base support member assembly, the vertical resistance and restorative force member assembly and the arm support member optionally are padded, as shown in the drawings, for comfort of the user.

Figure 2:
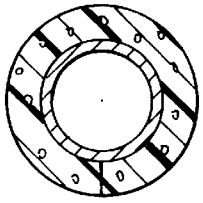
FIG. 2 is a cross-sectional view of the arm support member of the abdominal exercise device of FIG. 1 viewed in the direction of the line 2—2 of FIG. 1.
Figure 5:
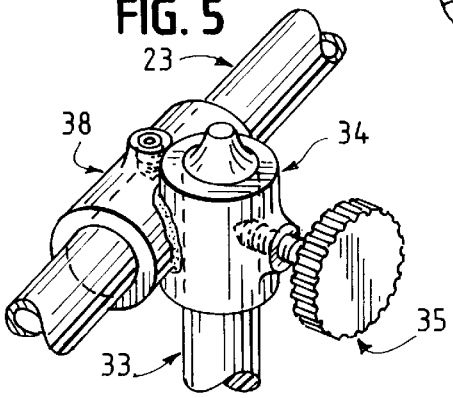
FIG. 5 is a perspective view of the attachment structure of the vertical resistance and restorative force member to the arm support member of FIG. 1.
Figure 3:
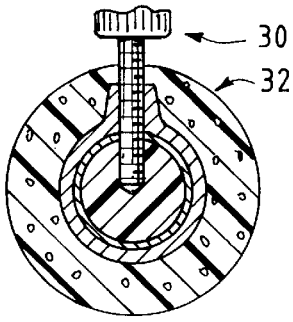
FIG. 3 is a sectional view of the support structure as viewed in the direction of the line 3—3 of FIG. 1.

FIGS. 1 through 16 illustrate the specific construction details of the abdominal exercise device. In this regard, it can be seen that the base support member assembly consists of a seat padded with cushioning material for the user's comfort and surfaced on the bottom with a friction resistant material to restrict movement on the surface on which the base support member assembly rests. The upright support structure alternatively can comprise a sleeve insertion device including a suitable opening in the base support member assembly into which the vertical member 33 of the vertical resistance and restorative force member assembly is inserted. The base support member assembly accordingly consists of a seat and an upright support structure, a cross-section of which is shown in FIG. 3 and an embodiment in FIG. 6. The vertical resistance and restorative force member assembly is secured in position by sleeve insertion into the upright support structure of the base support member assembly. The vertical resistance and restorative force member assembly consists of the vertical resistance and restorative force member and an arm member support structure, the details of which are shown in FIG. 5. The arm support member is secured in position by the arm member support structure of the vertical resistance and restoration force member assembly and affixed in position by a thumb screw fastener.

Figure 4:
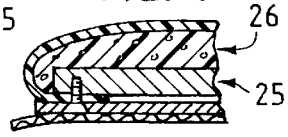
FIG. 4 is a sectional view of the base support member as viewed in the direction of the line 4—4 of FIG. 1.

FIG. 1 illustrates an embodiment. In this regard, it can be seen that the arm support member is padded, of which a cross-section for the padding is shown in FIG. 2. Similar or equivalent padding is applied to the vertical resistance and restorative force member assembly and the base support member assembly on which the user sits. As is apparent, the arm support member terminates with hand grips. An alternative embodiment of the arm support member is without hand grips. It can also be seen that the base support member assembly upon which the user sits is padded, of which a cross-section is shown in FIG. 4. An alternative embodiment of the base support member assembly is without padding and is curved to fit the human anatomy in a seated position.

Figure 7:
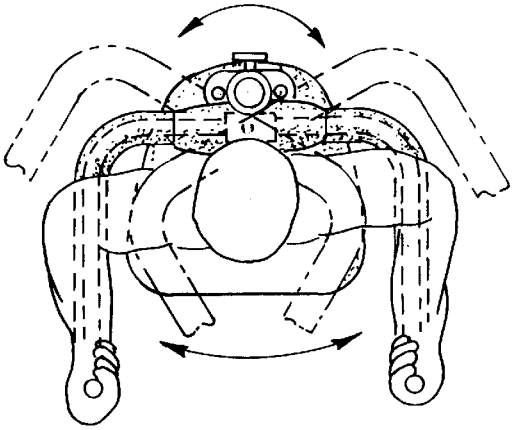
FIG. 7 is a top view of a person using the abdominal exercise device of FIG. 1 in an oscillatory waist twisting motion.
Figure 8:
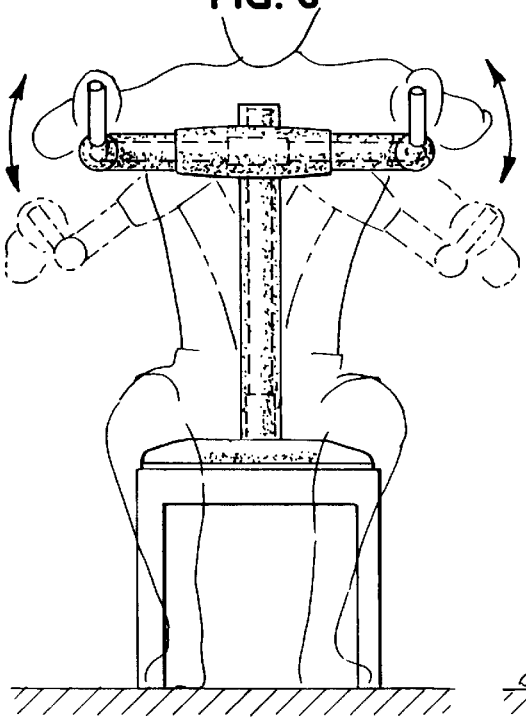
FIG. 8 is a front view of a person using the abdominal exercise device of FIG. 1 in an oscillatory waist sideways motion.
Figure 9:
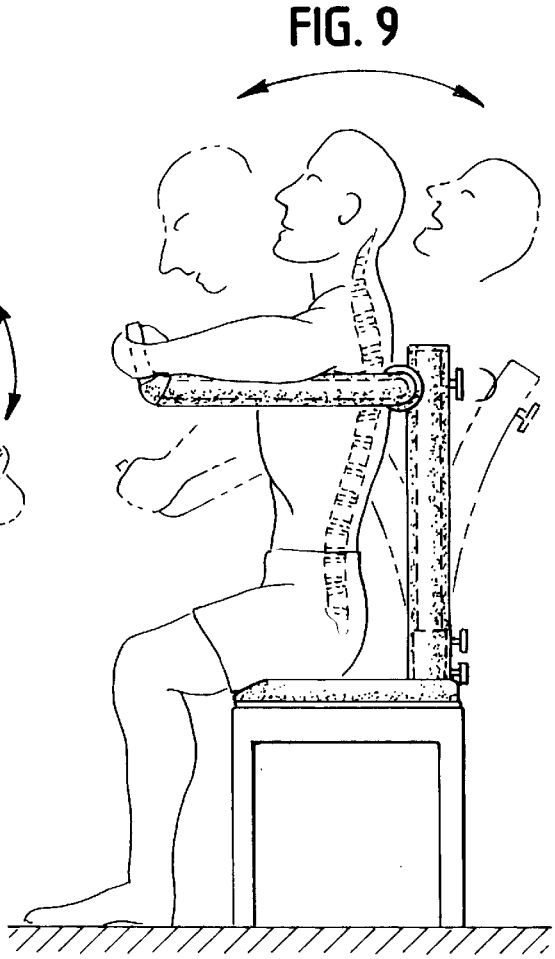
FIG. 9 is a cross-sectional side view of a person using the abdominal exercise device of FIG. 1 in an oscillatory forward and backward motion wherein the arm support member maintains the spinal column in a support mode.
Figure 10:
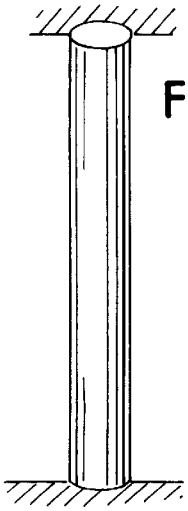
FIG. 10 is a pictorial representation of the vertical resistance and restorative force member of FIG. 1 depicting one embodiment of the vertical resistance force member comprising a round vertical column of elastomeric material.
Figure 11:
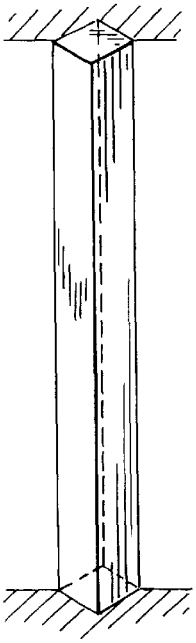
FIG. 11 is a pictorial representation of the vertical resistance and restorative force member of FIG. 1 depicting an embodiment of the vertical resistance force member comprising a vertical column as an energy storage device.
Figure 12:
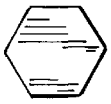
FIGS. 12, 13 and 14 are cross-sectional views of the alternative vertical resistance and restorative force member of FIG. 11.
Figure 13:
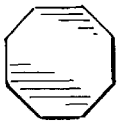
Figure 14:
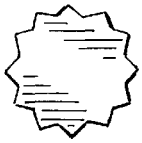
Figure 15:
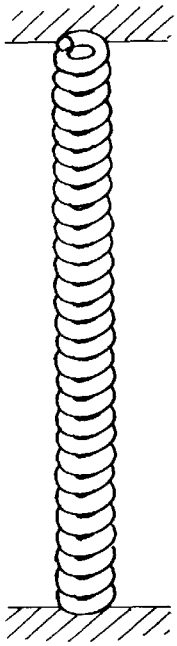
FIG. 15 is a pictorial representation of a coil spring as an element of the vertical resistance and restorative force member of FIG. 1.

FIGS. 7, 8 and 9 illustrate the method of use of the abdominal exercise device. As can be seen in FIG. 9, the user sits on the base support member assembly, his arms supported by the arm support member, with the user's upper torso supported by the positioning of his arms on the arm support member. The lower back and spinal column of the middle and lower torso of the user accordingly are in a support phase. The abdominal exercise device maintains this support phase during a twisting motion as seen in FIG. 7, a rocking motion as seen in FIG. 8, and a forward and backward motion as seen in FIG. 9. The range of movement of the user is limited only by the user's capability to bend forward, backward, sideways and to twist and rotate his upper torso against the force of the vertical resistance and restorative force member assembly in a full-range of movement of the user's upper torso.

In more detail, the vertical resistance and restorative force member assembly permits repetitive controlled resistance to movements of the upper torso of the user's body and permits repetitive exercising of the muscles of the user's body in a balanced procedure, the balance against strain of the lower back and muscles of the spinal column obtained by the arm support member which holds the upper torso and the spinal column in an upright normal alignment. With arms positioned on the upper arm support member, the user will be in normal body posture and spinal compression typically is avoided. The abdominal exercise device trains the user to sit upright while exercising, to maintain decompression to the spinal vertebrae and to permit a full range of movement of the upper torso of necessary exercise to increase body flexibility and muscle strength.

The vertical resistance and restorative force member assembly comprises an energy device which resists movement, such as a spring or an elastomeric material which resists deformation. Accordingly, the vertical resistance and restorative force member assembly comprises an energy storage device which provides resistance to movement and restores itself to a rest position. Suitable energy storage devices include a spring loaded flexible metal bar, a metal coil spring a coil spring of elastomeric material, a flexible torsion bar, a plastic column of elastomeric material resistant to deformation, a hydraulic mechanism means, a vertical member which terminates in a ball and socket joint positioned within an elastomeric embodiment, and combinations thereof. The elastomeric material can be an embodiment of a natural or synthetic polymer including natural and synthetic rubber and a fiber glass component. It is essential the elastomeric material is resistant to deformation stress and flexes and stores and releases energy in response to application and removal of force by a user of the arm support assembly.

The range of resistance to movement by the vertical resistance and restorative force member assembly member is determined by the physical characteristics of the structure of the vertical resistance and restorative force member including a spring loaded flexible metal bar, a metal coil spring, a flexible torsion bar, at vertical column of elastomeric material resistant to deformation stress or other energy saving device. The range of resistance to movement accordingly can be modified by the user to the user's level of exercise development by interchange of vertical resistance members with determinable ranges of resistance to movement.

An embodiment as in FIGS. 1 through 16 is subject to various modifications and alternative constructions without limiting the spirit and scope of the invention. The support structure for the vertical resistance and restorative force member assembly mounted on the base support member assembly can be modified to permit secure attachment of the vertical resistance and restorative force member assembly to the base support member assembly by mechanical attachment devices including mechanical clamps, vise mechanisms, force-fit holes in the base support member assembly, a fastening device comprising a rod, and a rod threaded to receive a nut and any mechanical holding device. The attachment structure of the vertical resistance and restorative force member assembly can be modified to permit secure attachment of the arm support member to the vertical resistance and restorative force member assembly by suitable mechanical attachment devices including mechanical clamps, vise mechanisms, a force-fit hole in the vertical resistance member assembly for insertion of the arm support member which can be in separable parts for easy mounting on the vertical resistance and restorative force member assembly.

Figure 6:
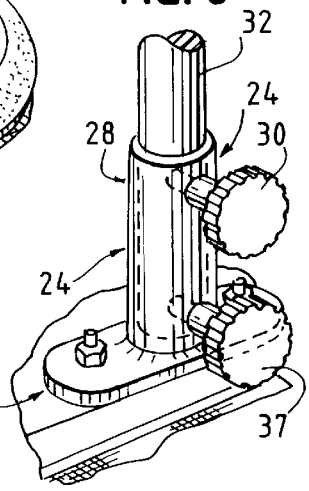
FIG. 6 is a perspective view of the support structure for the vertical resistance and restorative force member assembly of the base support member assembly of FIG. 1.

As shown in FIGS. 1 through 6 and FIGS. 9 through 16, the abdominal exercise device of this invention comprises a base support member assembly 21, a vertical resistance and restorative force member assembly 22, and an arm support member 23. The base support member assembly 21 serves as a seat for the user and is a platform for the vertical support structure 24. The base support member assembly platform 25 is of any material resistant to strain imposed upon the platform by stress from the vertical resistance and restorative force member assembly 22. The platform 25, a cross-section of which is shown in FIG. 4, contains an optional padding 26 for the user's comfort. Platform 25 is optionally curved to fit the human anatomy in a seated position as the seat of a chair, a saddle-shaped seat, and or a bench seat. Vertical support structure 24 as shown in FIG. 6 is affixed to base support assembly platform 25 by nuts and bolts 26 and 27. Vertical support structure 24 comprises an upright tubular sleeve member 28 mounted on a base support 29 and with threaded holes for knurled thumb screws 30 and 31 to engage the vertical resistance and restorative force member 33 in place which is inserted within the tubular sleeve member 28 of vertical support structure 24. Vertical resistance and restorative force assembly 22 can be encased optionally in padding 32 for the user's comfort. Vertical resistance and restorative force member assembly 22 comprises a vertical member 33 and an attachment structure 34 to engage the arm support member 23 as shown in FIG. 5. Attachment structure 34 fastens vertical resistance and restorative force member assembly to arm support member 33 by knurled thumb screw 35. Arm support member 23 is an elongated tubular U-shaped embodiment to extend around the upper body of the user to support the arms of the user. Hand grasps 36 and 37 at the ends of the arm support member 23 are positioned upward for ease of grasping by the user. Sleeve 38 into which the separate arms 39 and 40 fit of arm support member 23 holds left arm 39 and right arm 40 in position with attachment structure 34 and knurled thumb screw 35. Hand grasps 36 and 37 can be covered with rubber sheaths to maintain a secure grip.

Figure 16:
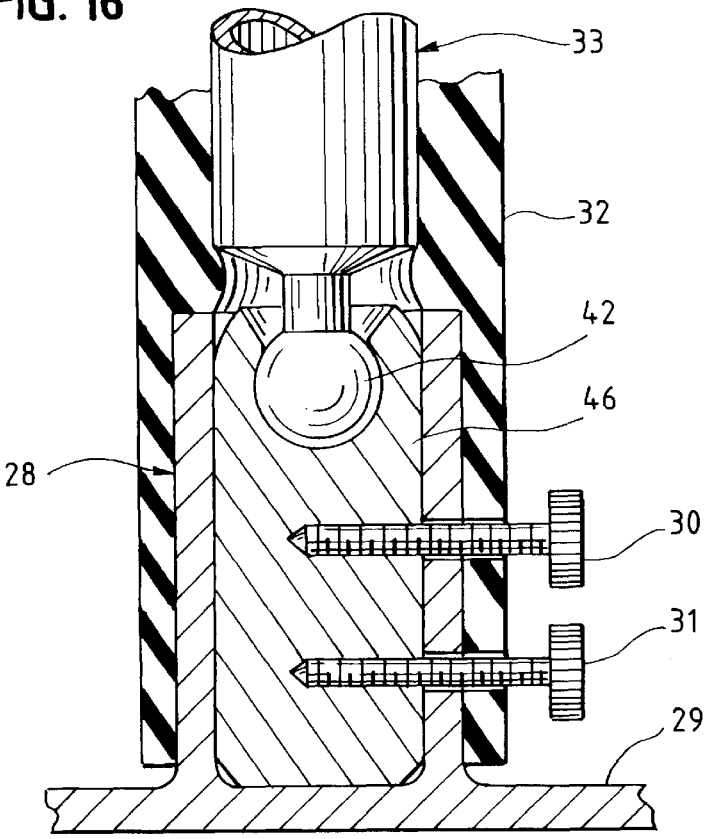
FIG. 16 is a cross-sectional view of an embodiment of the vertical resistance and force member assembly wherein the vertical resistance member of FIG. 1 terminates in a ball and socket joint, the vertical resistance and restorative force member positioned within an elastomeric material resistant to deformation.

An alternative embodiment of the vertical resistance force member is described with reference to FIG. 16. As shown in FIG. 16, the abdominal exercise device includes a ball and socket joint member 42 at the pivot point of the vertical member 33 and the vertical support structure 24. The vertical member pivots in a 360° movement upon the ball 42 and socket joint 46 against the resistance of elastomeric material 32 which is resistant to deformation stress, flexing and storing and releasing energy in response to movement of vertical member 33. Tubular sleeve member 28 of vertical support structure 24 mounted on base support 29 has knurled thumb screws 30 and 31 to engage the vertical resistance and restorative force member assembly 22 in place which is inserted within the tubular sleeve member 28.

The above descriptions are presented to be exemplary only and are not to be construed as limiting the scope of the invention. It is to be realized that the optimal dimensional relationships for the parts of the invention, to include variations in size, materials, shape, form, function and manner of operation, assembly and use, are readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to and which may fall by within the scope of the present invention.

What is claimed is:

1. An abdominal exercise device comprising in combination a U-shaped upper body—arm support member substantially extending a round the upper body of the user, a base support member assembly upon which an exerciser can sit while exercising, the base support member containing a support structure assembly to support a vertical resistance and restorative force member assembly vertically from the base support member assembly, said vertical resistance and restorative force member assembly containing an energy storage device and an attachment structure to attach the vertical resistance and resistive force member assembly to said U-shaped upper body—arm support member wherein the vertical resistance and restorative force assembly affords repetitive resistance and restorative movement of the U-shaped upper body—arm support member assembly caused by the user wherein said U-shaped upper body—arm support member assembly positions and supports the arm and upper body of the user to support the muscles of the spinal column of the user, to train the abdominals, and oblique muscles of the body and to avoid spinal compression by maintaining decompression of the spinal vertabrae.

2. The abdominal exercise device of claim 1 wherein the energy storage device of the vertical resistance and restorative force member assembly comprises a coil spring.

3. The abdominal exercise device of claim 1 wherein said energy storage device of the vertical resistance and restorative force assembly comprises a flexible torsion bar.

4. The abdominal exercise device of claim 3 wherein the flexible torsion bar is of a flexible elastomeric material resistant to repetitive deformation stress and flexes and stores and releases energy in response to application and removal of force by a user.

5. The abdominal exercise device of claim 1 wherein the energy storage device of the vertical resistance and restorative force assembly comprises a plastic column of elastomeric material resistant to repetitive deformation stress and flexes and stores and releases energy in response to application and removal of force by a user of the arm support assembly.

6. An abdominal exercise device comprising in combination a U-shaped upper body—arm support member substantially extending around the upper body of the user, a base support member assembly upon which a user can sit while exercising and containing a support structure assembly to support a vertical resistance and restorative force member assembly vertically from the base support member assembly, a vertical resistance and restorative force member assembly containing an energy storage device and an attachment structure to attach the vertical resistance and resistance force member assembly to said U-shaped upper body—arm support member, wherein the energy storage device of the vertical resistance and restorative force assembly comprises a vertical column which pivots on a ball-and-socket joint of the column and the vertical column is encased in an elastomeric material resistant to deformation stress, said elastomeric material flexing and storing and releasing energy in response to application and removal of force by a user of the U-shaped upper body—arm support.

7. The abdominal exercise device of claim 1 wherein the energy storage device of the vertical resistance and restorative force assembly is selected from a device selected from the group consisting of a spring loaded flexible metal bar, a metal coil spring, a coil spring of elastomeric material, a flexible torsion bar, a plastic column of elastomeric material resistant to deformation, a hydraulic mechanism means, a vertical member which terminates in a ball and socket joint encased in an elastomeric material.

8. The abdominal exercise device of claim 1 wherein the support structure of the base support member assembly comprises an opening in the base support member assembly into which is inserted said vertical resistance and restorative force member.

* * * * *